US009324261B2

(12) United States Patent
Lee

(10) Patent No.: US 9,324,261 B2
(45) Date of Patent: Apr. 26, 2016

(54) ORGANIC LIGHT EMITTING DIODE DISPLAY DEVICE

(71) Applicant: LG Display Co., Ltd., Seoul (KR)

(72) Inventor: Hyunjae Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 697 days.

(21) Appl. No.: 13/629,274

(22) Filed: Sep. 27, 2012

(65) Prior Publication Data

US 2013/0082910 A1 Apr. 4, 2013

(30) Foreign Application Priority Data

Sep. 29, 2011 (KR) ..... 10-2011-0099237

(51) Int. Cl.
*G09G 5/10* (2006.01)
*G09G 3/32* (2016.01)

(52) U.S. Cl.
CPC ..... *G09G 3/3208* (2013.01); *G09G 2320/02* (2013.01); *G09G 2330/021* (2013.01); *G09G 2330/025* (2013.01); *G09G 2330/028* (2013.01); *G09G 2330/04* (2013.01); *G09G 2340/0435* (2013.01)

(58) Field of Classification Search
CPC ..... G06F 3/044; G06F 3/0412; G09G 3/3233
USPC ..... 345/76, 531, 690
See application file for complete search history.

(56) References Cited

U.S. PATENT DOCUMENTS

| | | | | |
|---|---|---|---|---|
| 7,259,521 | B1 * | 8/2007 | Ritter | 315/169.1 |
| 8,072,400 | B2 * | 12/2011 | Mizukoshi et al. | 345/77 |
| 2009/0109147 | A1 * | 4/2009 | Park et al. | 345/76 |
| 2009/0201231 | A1 * | 8/2009 | Takahara | G09G 3/3233 345/76 |
| 2010/0156965 | A1 | 6/2010 | Kim et al. | |

FOREIGN PATENT DOCUMENTS

| | | | |
|---|---|---|---|
| DE | 10 2008 025 916 | A1 | 4/2009 |
| DE | 10 2011 081 498 | A1 | 3/2012 |
| KR | 10-0894606 | B1 | 4/2009 |
| KR | 10-2010-0047694 | A | 5/2010 |

OTHER PUBLICATIONS

Korean Intellectual Property Office, Office Action, Korean Patent Application No. 10-2011-0099237, May 12, 2014, five pages [with concise explanation of relevance in English].
German Patent Office, Office Action, German Patent Application No. 10 2012 216 212.7, Dec. 9, 2014, ten pages.

* cited by examiner

*Primary Examiner* — Calvin C Ma
(74) *Attorney, Agent, or Firm* — Fenwick & West LLP

(57) ABSTRACT

An organic light emitting diode (OLED) display includes a display panel including data lines, scan lines crossing the data lines, and pixels which each include an organic light emitting diode and are arranged in a matrix form, a power generator which is enabled in a normal mode to generate a high potential power voltage for driving the display panel and is disabled in a low power mode, and a panel driving circuit which drives the data lines and the scan lines, disables the power generator in the low power mode to cut off an output of the power generator, and supplies an internal power less than the high potential power voltage to the display panel to reduce the high potential power voltage in the low power mode.

17 Claims, 12 Drawing Sheets

[Normal Mode]

[Partial Idle Mode]

ORGANIC LIGHT EMITTING DIODE DISPLAY DEVICE

CROSS-REFERENCE TO RELATED APPLICATION

This application claims the benefit of Korean Patent Application No. 10-2011-0099237 filed on Sep. 29, 2011, the entire contents of which is incorporated herein by reference for all purposes as if fully set forth herein.

BACKGROUND OF THE INVENTION

1. Field of the Invention

Embodiments of the invention relate to an organic light emitting diode (OLED) display.

2. Discussion of the Related Art

Various flat panel displays (FPDs), that may replace cathode ray tubes (CRTs), have been developed. Examples of the FPDs include a liquid crystal display (LCD), a field emission display (FED), a plasma display panel (PDP) display, and an organic light emitting diode (OLED) display.

A mobile LCD using MIPI (Mobile Industry Processor Interface) supports a low power mode for low power drive. The low power mode has been known as a partial idle mode (PIM) or a dimmed low power (DLP) mode. In the low power mode, the mobile LCD operates at low power consumption, for example, by turning off a backlight unit. In the low power mode, because the mobile LCD displays previously determined data by reflecting external light like a reflective LCD, the mobile LCD cannot arbitrarily adjust its luminance.

The OLED is a self-emitting element that does not have a backlight unit. Thus, the OLED display cannot apply the low power mode of the mobile LCD as it is. The OLED display drives pixels using a high pixel driving voltage to display an input image with a high luminance in a normal mode and reduces power consumption though a reduction in the pixel driving voltage in the low power mode. However, the pixel driving voltage increases for a period of time when the lower power mode is changed into the normal power mode, and thus a current flowing through OLEDs of the pixels may change. As a result, the luminance of the pixels of the OLED display may rapidly change when the low power mode is changed into the normal mode.

SUMMARY OF THE INVENTION

Embodiments of the invention provide an organic light emitting diode (OLED) display capable of preventing rapid changes in the luminance of pixels when the operation mode of the OLED display changes from a low power mode to a normal mode.

In one embodiment, an OLED display comprises a display panel including data lines, scan lines intersecting with the data lines, and a plurality of pixels each of which includes an organic light emitting diode and are arranged in a matrix form; a power generator configured to generate a first voltage as a supply voltage for driving the pixels of the display panel in a first mode (e.g., normal operation mode) of the OLED display and is disabled in a second mode (e.g., lower power operation mode) of the OLED display; and a panel driving circuit configured to drive the data lines and the scan lines of the display panel. The panel driving circuit is further configured to disable the power generator in the second mode and provide a second voltage lower than the first voltage as the supply voltage for driving the pixels of the display panel in the second mode. When there is a change of an operation mode of the OLED display from the second mode to the first mode, the power generator is configured to generate the first voltage for driving the display panel at a time synchronized with a vertical blank period of an image signal to be displayed on the OLED display. As a result, it is possible to prevent rapid changes in the luminance of the display panel from occurring when the operation mode of the OLED display is changed from the low power mode to the normal operation mode.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to embodiments of the invention, examples of which are illustrated in the accompanying drawings. Wherever possible, the same reference numbers will be used throughout the drawings to refer to the same or like parts.

Figure 1:
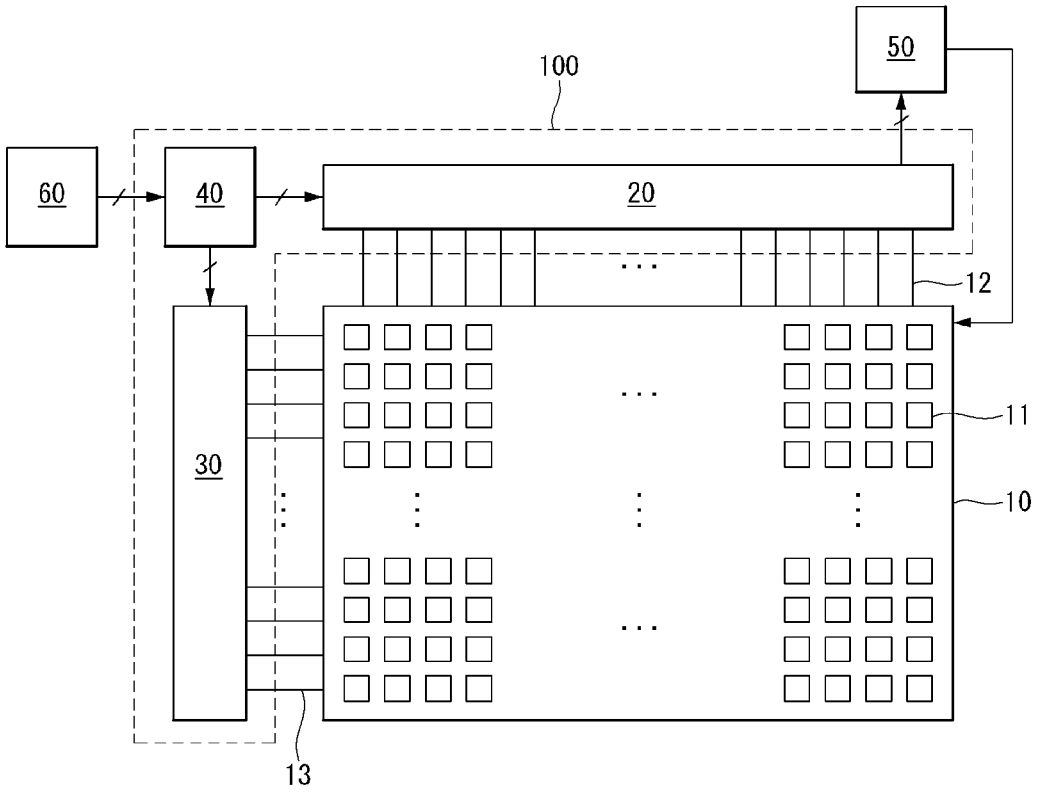
FIG. 1 is a block diagram of an organic light emitting diode (OLED) display according to an example embodiment.
Figure 2:
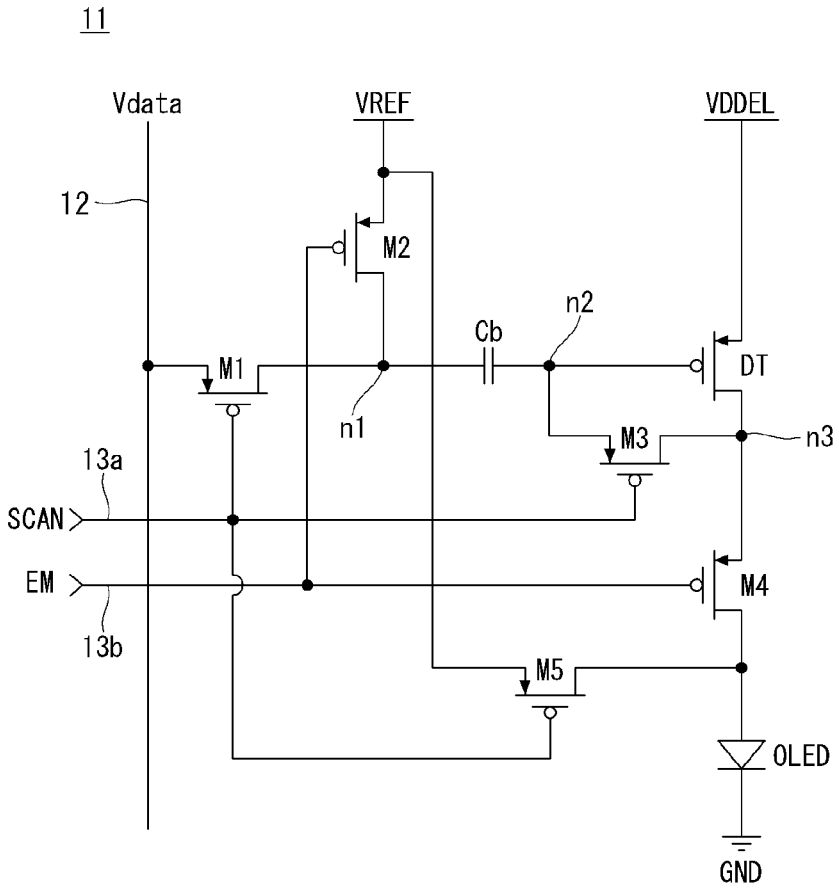
FIG. 2 is a circuit diagram illustrating in detail a pixel of the OLED display shown in FIG. 1.
Figure 3:
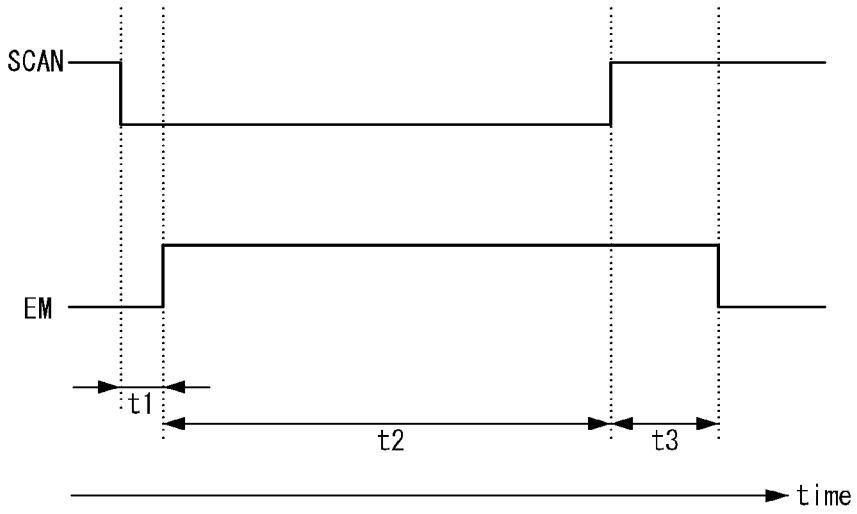
FIG. 3 is a waveform diagram illustrating driving signals of the pixel shown in FIG. 2 in a normal mode.

As shown in FIGS. 1 to 3, an organic light emitting diode (OLED) display according to an embodiment includes a display panel 10, a data driver 20, a scan driver 30, a power generator 50, and a timing controller 40.

The display panel 10 includes data lines 12 for receiving a data voltage, scan lines 13 which intersect with the data lines 12 and sequentially receive a scan pulse SCAN and a light emitting control pulse EM, and pixels 11 arranged in a matrix form. The pixels 11 receive a high potential power voltage VDDEL as a pixel driving voltage. As shown in FIG. 2, each of the pixels 11 includes a plurality of thin film transistors (TFTs), a capacitor Cb, and an OLED. The pixel 11 is initialized in response to the scan pulse SCAN and samples a threshold voltage of a driving TFT DT. The OLED of the pixel 11 emits light by a current flowing through the driving TFT DT during a logic low period (or a light emitting period) of the light emitting control pulse EM.

The data driver 20 converts digital video data RGB into a gamma compensation voltage under the control of the timing controller 40 and generates the data voltage using the gamma compensation voltage. The data driver 20 supplies the data voltage to the data lines 12. The scan driver 30 supplies the scan pulse SCAN and the light emitting control pulse EM to the scan lines 13 under control of the timing controller 40.

The power generator 50 is enabled to generate the high potential power voltage VDDEL for driving the pixels 11 in a normal mode, in which the digital video data RGB is normally displayed. The power generator 50 is disabled to generate no output in a low power mode.

If the output of the power generator 50 rapidly increases, a voltage drop may be generated in a battery due to an inrush current. The voltage drop of the battery may cause a malfunction of other circuit components. The power generator 50 may slowly increase its output using a low dropout (LDO) regulator (not shown) having a soft start function and may reduce the inrush current, so as to prevent the malfunction. The LDO regulator generates an output voltage having a potential proportional to a potential of a reference voltage LDO REF. Thus, if the reference voltage LDO REF gradually increases in a ramp waveform, a potential of the high potential power voltage VDDEL output from the LDO regulator may gradually increase, thereby achieving a soft start. A soft start time may be adjusted using a slope of the ramp waveform.

Figure 4:
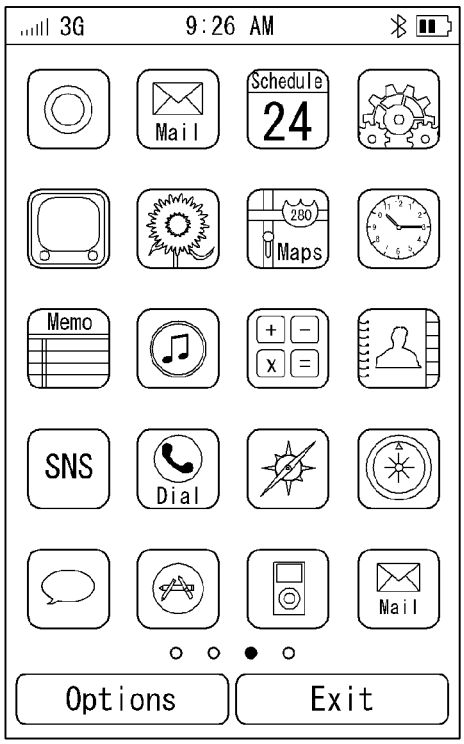
FIG. 4 illustrates an example of a user interface image displayed on an OLED display in a normal mode according to an example embodiment.
Figure 5:
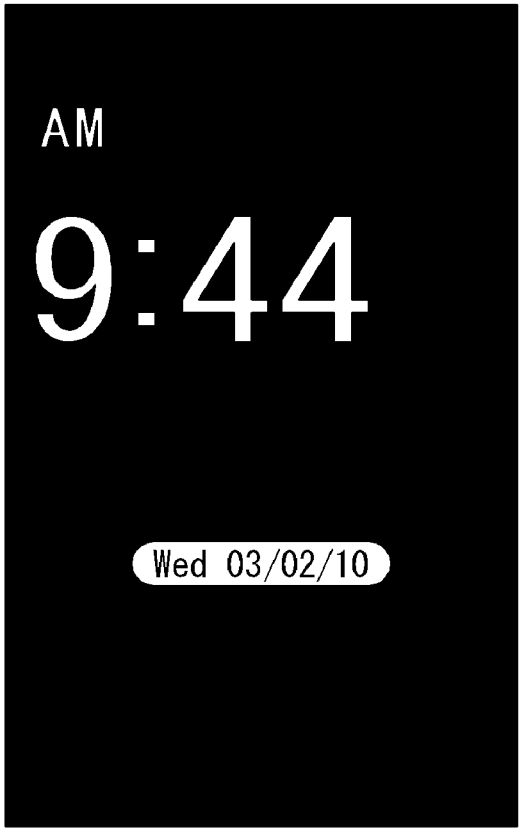
FIG. 5 illustrates an example of a low power image displayed on an OLED display in a low power mode according to an example embodiment.

In the normal mode, the timing controller 40 supplies an input image received from a host system 60 or digital video data of a previously determined user interface image of FIG. 4 to the data driver 20. In the low power mode, the timing controller 40 supplies data of a low power image previously stored in an internal memory to the data driver 20. For example, as shown in FIG. 5, the low power image may be an image of low luminance including time information displayed on a background of a black gray level. Alternatively, the low power image data may be set to various DLP (dimmed low power) image data driven at low power consumption.

The timing controller 40 receives external timing signals such as a vertical sync signal, a horizontal sync signal, and clocks from the host system 60, and generates timing control signals for controlling operation timings of the data driver 20 and the scan driver 30 based on the external timing signals. The vertical sync signal is generated once during one frame period at start timing and may function as a tearing effect (TE) signal for distinguishing a frame period from another frame period.

The host system 60 may be connected to an external video source equipment, such as a navigation system, a set-top box, a DVD player, a Blu-ray player, a personal computer, a home theater system, a broadcasting receiver, and a phone system, and may receive image data from the external video source equipment. The host system 60 converts the image data received from the external video source equipment or user interface image data into a data format suitable for display on the display panel 10 using a system-on-chip (SoC) including a scaler embedded therein. The host system 60 transfers the image data to the timing controller 40. The host system 60 may transfer a mode conversion command for changing the operation mode of the OLED display 10 from the normal mode to the low power mode to the timing controller 40 in response to a user command, a communication standby state, a data no-input count result, etc.

The data driver 20, the scan driver 30, and the timing controller 40 may be integrated into a panel driving circuit chip 100.

As shown in FIG. 2, each of the pixels 11 includes the OLED, the six TFTs M1 to M5 and DT, and the capacitor Cb. The driving voltages, such as the high potential power voltage VDDEL, a ground level voltage VSS (or GND), or a reference voltage VREF, are supplied to each of the pixels 11. The TFTs M1 to M5 and DT may be implemented as p-type metal oxide semiconductor field effect transistors (MOSFETs).

The high potential power voltage VDDEL supplied to the pixels 11 in the normal mode is greater than the high potential power voltage VDDEL supplied to the pixels 11 in the low power mode. A difference between the high potential power voltage VDDEL of the normal mode and the high potential power voltage VDDEL of the low power mode is too small to rapidly change a screen luminance when the low power mode is changed into the normal mode. According to an experimental result, it is preferable, but not required, that the difference between the high potential power voltage VDDEL of the normal mode and the high potential power voltage VDDEL of the low power mode is equal to or less than about 3.45V.

The reference voltage VREF is set so that a difference between the reference voltage VREF and the ground level voltage GND is less than a threshold voltage of the OLED. For example, the reference voltage VREF may be set to about 2V.

When the reference voltage VREF is applied to an anode electrode of the OLED and the ground level voltage GND is applied to a cathode electrode of the OLED, the OLED does not emit light because the OLED is not turned on. The reference voltage VREF may be set to a negative voltage so that a reverse bias may be applied to the OLED when the driving TFT DT connected to the OLED is initialized. In this instance, because the reverse bias is periodically applied to the OLED, the degradation of the OLED may be reduced. As a result, the life span of the OLED may increase.

The first switch TFT M1 is turned on in response to a scan pulse SCAN, which is generated at a low logic level for first and second times t1 and t2 of FIG. 3, thereby forming a current path between a first node n1 and the data line 12. The third switch TFT M3 is turned on in response to the scan pulse SCAN of FIG. 3, thereby forming a current path between a second node n2 and a third node n3. Hence, the third switch TFT M3 operates the driving TFT DT as a diode. The fifth switch TFT M5 is turned on in response to the scan pulse SCAN of FIG. 3, thereby supplying the reference voltage VREF to the anode electrode of the OLED. In the first switch TFT M1, a source electrode is connected to the data line 12, a drain electrode is connected to the first node n1, and a gate electrode is connected to a scan line 13*a* to which the scan pulse SCAN is supplied. In the third switch TFT M3, a source electrode is connected to the second node n2, a drain electrode is connected to the third node n3, and a gate electrode is connected to the scan line 13*a* to which the scan pulse SCAN is supplied. The reference voltage VREF is supplied to a source electrode of the fifth switch TFT M5. A drain electrode of the fifth switch TFT M5 is connected to the anode electrode of the OLED, and a gate electrode of the fifth switch TFT M5 is connected to the scan line 13*a* to which the scan pulse SCAN is supplied.

The first node n1 is connected to the drain electrode of the first switch TFT M1, a drain electrode of the second switch TFT M2, and one terminal of the capacitor Cb. The second node n2 is connected to the other terminal of the capacitor Cb, a gate electrode of the driving TFT DT, and the source electrode of the third switch TFT M3. The third node n3 is connected to the drain electrode of the third switch TFT M3, a drain electrode of the driving TFT DT, and a source electrode of the fourth switch TFT M4.

The second and fourth switch TFTs M2 and M4 are turned off in response to the light emitting control pulse EM, which is generated at a high logic level during second and third times t2 and t3 of FIG. 3, and are held in an ON-state for the remaining time. The reference voltage VREF is supplied to a source electrode of the second switch TFT M2, and a drain electrode of the second switch TFT M2 is connected to the first node n1. A gate electrode of the second switch TFT M2 is connected to a scan line 13*b* to which the light emitting control pulse EM is supplied. A source electrode of the fourth switch TFT M4 is connected to the third node n3, and a drain electrode of the fourth switch TFT M4 is connected to the anode electrode of the OLED and the drain electrode of the fifth switch TFT M5. A gate electrode of the fourth switch TFT M4 is connected to the scan line 13*b* to which the light emitting control pulse EM is supplied.

The capacitor Cb is connected between the first node n1 and the second node n2. The capacitor Cb samples the threshold voltage of the driving TFT DT during the first time t1 as shown in FIG. 3. The capacitor Cb supplies the gate electrode of the driving TFT DT with the data voltage, which is compensated as much as the threshold voltage of the driving TFT DT, after the second time t2. The driving TFT DT receives the voltage of the capacitor Cb as a gate voltage and adjusts an amount of current flowing in the OLED depending on the data voltage Vdata compensated as much as its threshold voltage. The high potential power voltage VDDEL is supplied to a source electrode of the driving TFT DT. The drain electrode of the driving TFT DT is connected to the third node n3, and the gate electrode of the driving TFT DT is connected to the second node n2.

The anode electrode of the OLED is connected to the drain electrodes of the fourth and fifth switch TFTs M4 and M5, and the cathode electrode of the OLED is connected to the ground level voltage source GND. The current flowing in the OLED, referred to as $I_{OLED}$ in Equation 1 below, is not affected by the deviation of the threshold voltage of the driving TFT DT or the high potential power voltage VDDEL as indicated by the following Equation 1:

$$I_{OLED} = k(Vdata - VREF)^2, \quad (1)$$

$$k = \frac{1}{2}(\mu Cox\, W/L)$$

where 'k' is a constant that is a function of mobility μ, parasitic capacitance Cox, and the channel ratio W/L of the driving TFT DT.

The waveform of FIG. 3 is a waveform obtained when the pixels are driven in the normal mode. In the waveform shown in FIG. 3, the first time t1 exists between a pulse start time (or a falling time) of the scan pulse SCAN (when the logic level of the scan pulse SCAN falls from the high logic level to the low logic level) and a pulse start time (or a rising time) of the light emitting control pulse EM (when the logic level of the light emitting control pulse EM rises from the low logic level to the high logic level). In the normal mode, voltages of both the scan pulse SCAN and the light emitting control pulse EM are at the low logic level voltage during the first time t1. The first to fifth switch TFTs M1 to M5 are turned on during the first time t1 for initializing the pixels. During the first time t1, the voltage of the first node n1 and the voltage of the anode electrode of the OLED are initialized to the reference voltage VREF, and the capacitor Cb samples the threshold voltage of the driving TFT DT.

Figure 6:
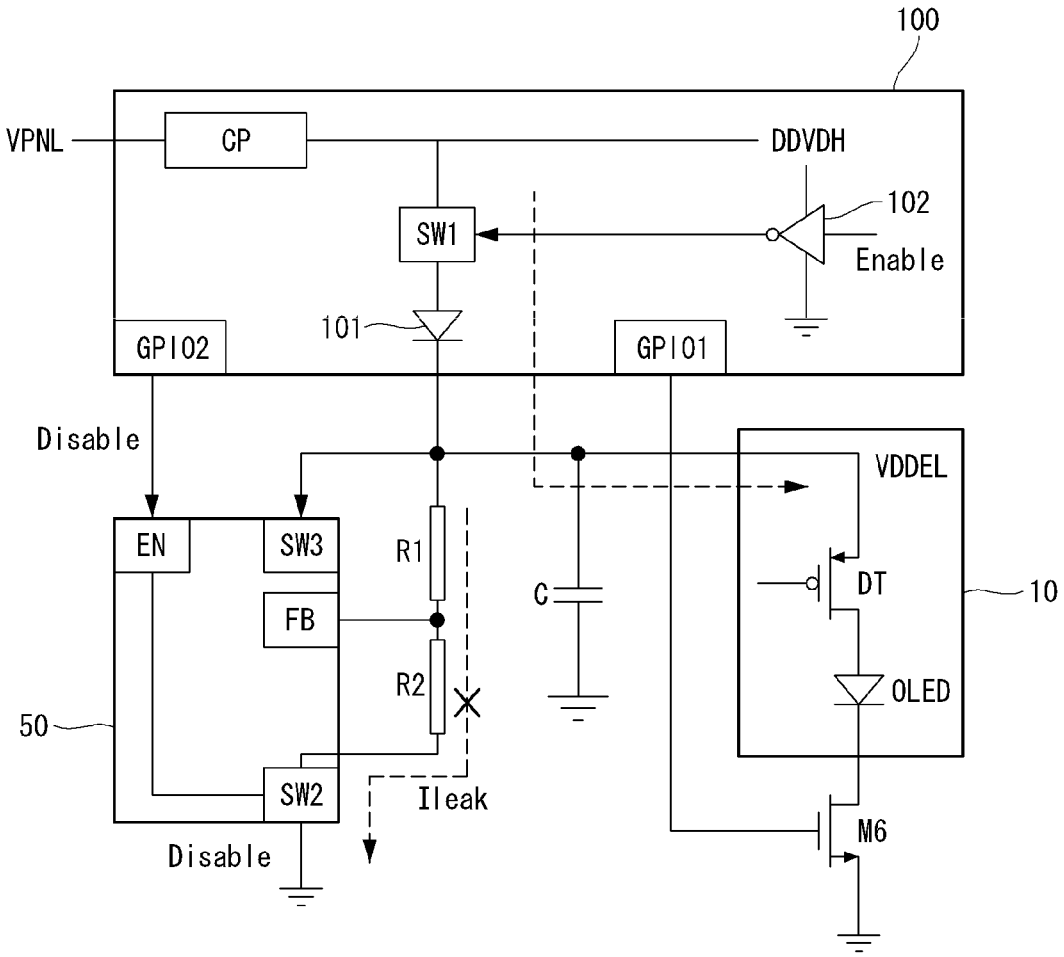
FIG. 6 illustrates a disable operation of a power generator and a switching operation of a high potential power voltage under the control of a panel driving circuit chip in a low power mode.

As shown in FIG. 6, the cathode electrode of the OLED may be connected to the ground level voltage source GND through a sixth switch TFT M6. The sixth switch TFT M6 may be implemented as an N-type MOSFET (NMOS). The sixth switch TFT M6 is mounted on a printed circuit board (PCB) or a flexible printed circuit board (FPCB), on which the panel driving circuit chip 100 is mounted. The sixth switch TFT M6 controls a light emitting timing and a non-light emitting timing of the OLED in the normal mode and the low power mode. In the embodiment of the invention, the sixth switch TFTs M6 may be not connected to the pixels 11, respectively. Namely, one sixth switch TFT M6 may be commonly connected to all of the pixels 11. In this instance, one sixth switch TFT M6 may be mounted on the PCB or the FPCB. A source electrode of the sixth switch TFT M6 is connected to the cathode electrodes of the OLEDs formed on the respective pixels 11 of the display panel 10, and a drain electrode of the sixth switch TFT M6 is connected to the ground level voltage source GND. A gate electrode of the sixth switch TFT M6 is connected to a first low power mode control terminal GPIO1 of the panel driving circuit chip 100. The sixth switch TFT M6 is held in the ON-state when an output voltage of the first low power mode control terminal GPIO1 has the high logic level, thereby connecting the OLEDs of the pixels 11 to the ground level voltage source GND. When the output voltage of the first low power mode control terminal GPIO1 is inverted to the low logic level, the sixth switch TFT M6 is turned off, thereby cutting off a current path between the OLEDs of the pixels 11 and the ground level voltage source GND.

Figure 12:
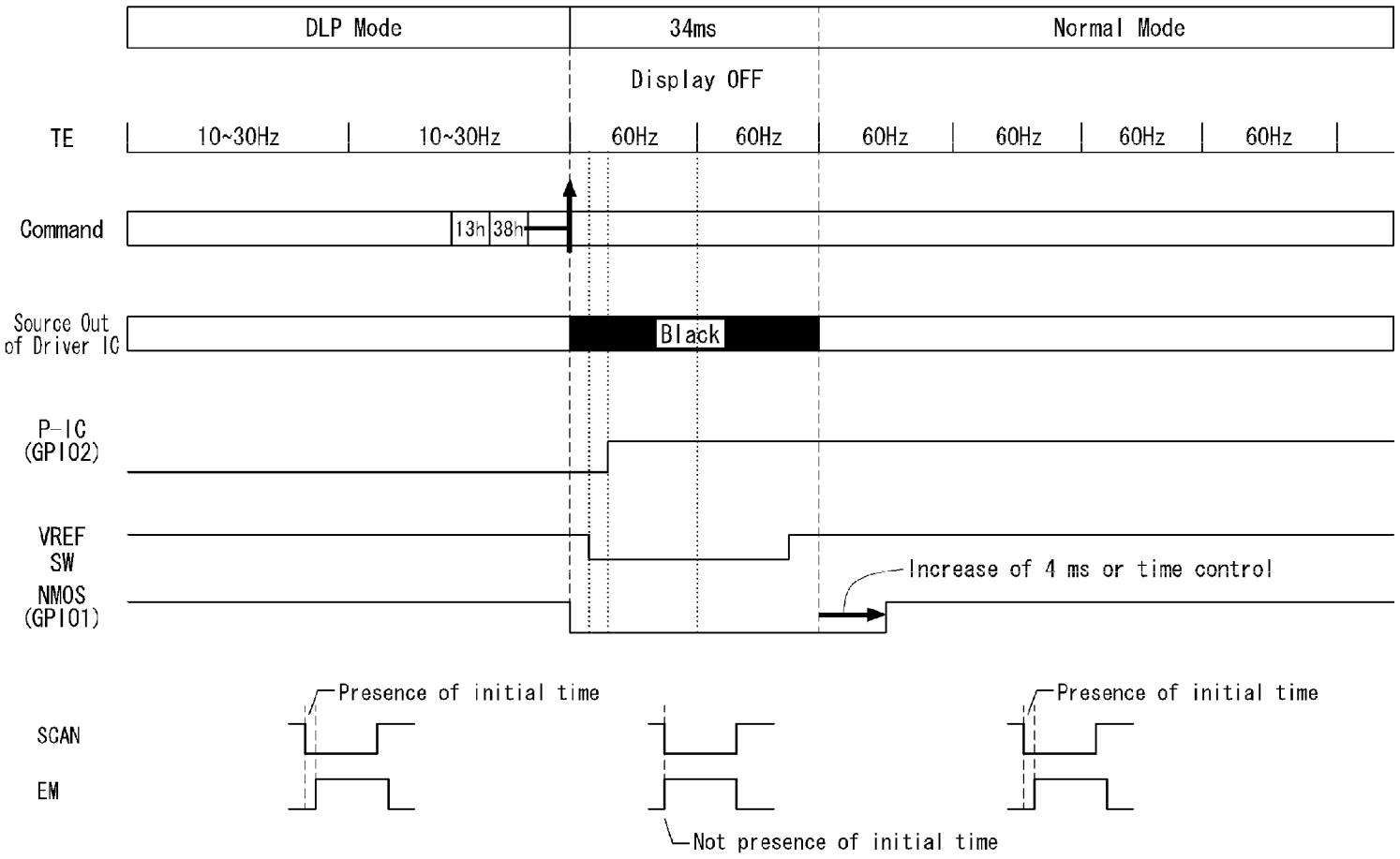
FIG. 12 illustrates changes in timings of a scan pulse and a light emitting control pulse in a low power mode and a normal mode of the OLED display, according to one embodiment.

As shown in FIG. 6, in the low power mode, the panel driving circuit chip 100 cuts off the output of the power generator 50 and replaces the output of the power generator 50 with a DC voltage DDVDH reduced by a threshold voltage of a diode 101. The panel driving circuit chip 100 supplies the DC voltage DDVDH to the pixels 11. As shown in FIG. 12, the panel driving circuit chip 100 reduces the frame frequency (for example, about 10 Hz to 30 Hz) during the low power mode to about ⅓ of the frame frequency (for example, about 60 Hz) during the normal mode, thereby reducing the image update frequency. Hence, the power consumption is reduced.

In the normal mode, the panel driving circuit chip 100 reads out pixel data including only most significant bit (MSB) of each of R, G, and B data from an internal frame memory and displays the low power image (for example, the low power image of FIG. 5) on the display panel 10. 24 bits of each pixel data of the low power image are stored in the internal frame memory of the panel driving circuit chip 100, wherein each of R, G, and B data has 8 bits and thus each pixel data is 24 bits (=3×8 bits). On the other hand, in the low power, the panel driving circuit chip 100 reads out pixel data of the low power image including only MSB of each of R, G, and B data. Then, the panel driving circuit chip 100 converts the pixel data of three MSBs into analog gamma compensation voltages. Hence, in the low power, the panel driving circuit chip 100 displays the low power image using only eight colors ($=2^3$). In the low power, the panel driving circuit chip 100 reads out only three MSBs from the internal frame memory SRAM and gamma-corrects only three MSBs, thereby further reducing the power consumption.

In the normal mode, the panel driving circuit chip 100 writes 24 bits of each pixel data of video data on the internal frame memory SRAM and reads out 24 bits of each pixel data. Thus, in the normal mode, the panel driving circuit chip 100 displays a full color image having gray values much more than the number of gray values in the low power mode.

FIG. 6 illustrates a disable operation of the power generator 50 and a switching operation of the high potential power voltage VDDEL under the control of the panel driving circuit chip 100 in the low power mode. FIG. 6 shows only part of a circuit configuration including the panel driving circuit chip 100, the power generator 50, and the display panel 10, which involves the switching operation of the high potential power voltage VDDEL in the low power mode.

As shown in FIG. 6, the panel driving circuit chip 100 further includes a charge pump CP, a first switch SW1, the diode 101, etc.

The charge pump CP receives a battery voltage VPNL of about 2.3V to 4.8V and increases the battery voltage to the DC voltage DDVDH. The DC voltage DDVDH output from the charge pump CP is less than the high potential power voltage VDDEL output from the power generator 50 in the normal mode. A difference between the DC voltage DDVDH and the high potential power voltage VDDEL is equal to or less than about 3.45V.

The panel driving circuit chip 100 adjusts the DC voltage DDVDH output from the charge pump CP to the reference voltage VREF using the regulator, and supplies the adjusted voltage to each of the pixels 11 of the display panel 10 through a power capacitor C.

The first switch SW1 is turned on in response to a mode conversion command received from the host system 60 through a buffer 102 to enter low power mode. The first switch SW1 may be implemented as an N-type MOSFET (NMOS) including a drain electrode connected to an output terminal of the charge pump CP, a source electrode connected to an anode electrode of the diode 101, and a gate electrode connected to an inverse output terminal of the buffer 102. The mode conversion command may be generated to be at a high logic level in the normal mode and at a low logic level in the low power mode. When the mode conversion command is generated at the high logic level in the normal mode, an inverse output voltage of the buffer 102 has a low logic level. In the normal mode, the first switch SW1 is held in an OFF-state and cuts off a current path between the charge pump CP and the diode 101. In the low power mode, the mode conversion command is inverted to the low logic level, and the inverse output voltage of the buffer 102 is inverted to the high logic level. In the low power mode, the first switch SW1 is turned on and forms a current path between the charge pump CP and the diode 101. The first switch SW1 supplies the output voltage DDVDH of the charge pump CP to the diode 101.

The panel driving circuit chip 100 inverts an enable or disable signal output through a second low power mode control terminal GPIO2 in response to the mode conversion command received from the host system 60. For example, in the normal mode, the panel driving circuit chip 100 outputs the enable/disable signal at a high logic level through the second low power mode control terminal GPIO2 and enables the power generator 50. On the other hand, in the low power mode, the panel driving circuit chip 100 outputs the enable/disable signal a low logic level through the second low power mode control terminal GPIO2 and disables the power generator 50.

The power generator 50 includes an enable terminal EN connected to the second low power mode control terminal GPIO2 of the panel driving circuit chip 100, a second switch SW2, a third switch SW3, etc. In the normal mode, the power generator 50 is enabled in response to the enable/disable signal at the high logic level and generates the high potential power voltage VDDEL for driving the pixels 11 of the display panel 10.

The power generator 50 detects a variation of a feedback signal input to a feedback terminal FB through a feedback voltage divider circuit comprised of first and second resistors R1 and R2, and adjusts the output of the power generator 50. The power generator 50 uniformly holds the high potential power voltage VDDEL supplied to the pixels 11 of the display panel 10 even when a load of the display panel 10 changes.

In the normal mode, the second switch SW2 connects the second resistor R2 of the feedback voltage divider circuit to the ground level voltage source GND in response to the enable signal at the high logic level. The first resistor R1 of the feedback voltage divider circuit is connected to the high voltage power supply terminal of the display panel 10 and the capacitor C. The second switch SW2 may be implemented as an N-type MOSFET (NMOS) including a source electrode connected to the second resistor R2, a drain electrode connected to the ground level voltage source GND, and a gate electrode to which the enable/disable signal is applied through the enable terminal EN.

In the low power mode, the power generator 50 is disabled in response to the disable signal at the low logic level to generate no output. Further, in the low power mode, the second switch SW2 is turned off in response to the disable signal at the low logic level and cuts off a leakage current Ileak flowing in the ground level voltage source GND through the feedback voltage divider circuit to the ground voltage source GND, thereby reducing the power consumption.

The third switch SW3 of the power generator 50 may be used to discharge charges remaining at the power capacitor C. In one embodiment, the third switch SW3 is held in the OFF-state in the normal mode and the low power mode.

Figure 10:
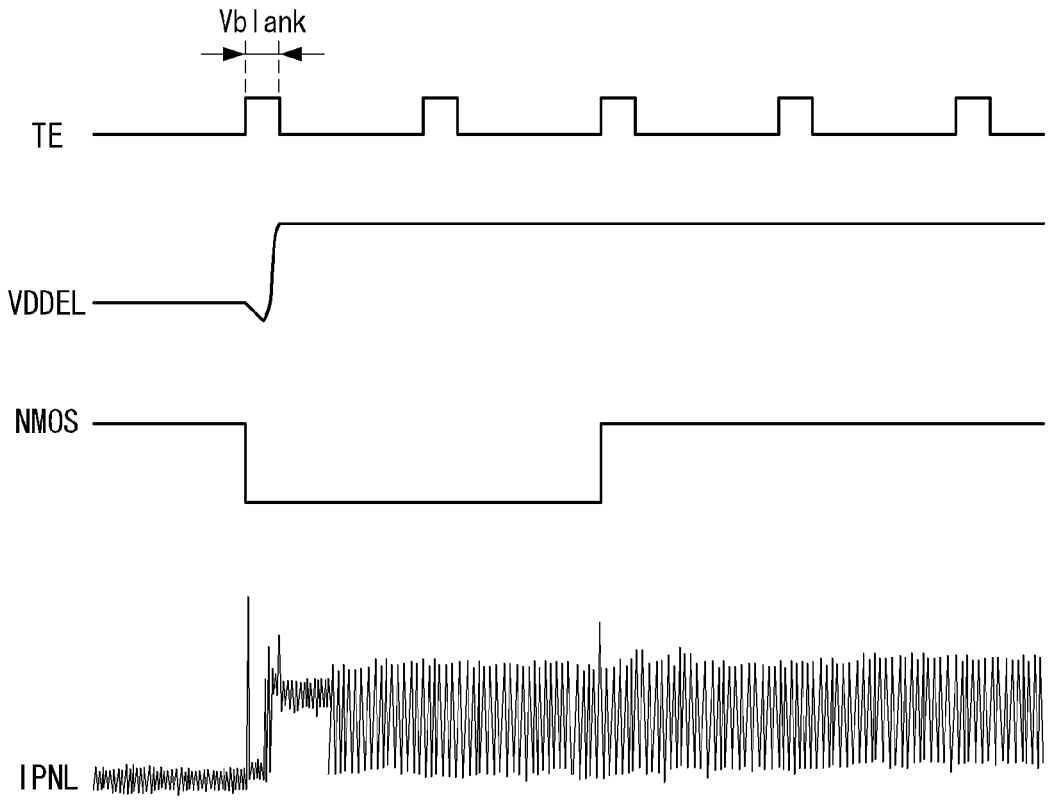
FIG. 10 illustrates an experimental result indicating that a vertical blank period widens for a predetermined period of time immediately after the operation mode of the OLED display is changed from a low power mode to a normal mode, and a soft start time of a power generator is controlled within the widening vertical blank period, according to an embodiment.

When the normal mode is changed into the low power mode, the output (i.e., the high potential power voltage VDDEL) of the power generator 50 is cut off, and at the same time, the output (i.e., the DC voltage DDVDH) of the charge pump CP of the panel driving circuit chip 100 is supplied to the pixels 11 of the display panel 10 through the first switch SW1 and the diode 101. On the contrary, when the low power mode is changed into the normal mode, the output (i.e., the DC voltage DDVDH) of the charge pump CP of the panel driving circuit chip 100 is cut off, and at the same time, the output (i.e., the high voltage VDDEL) of the power generator 50 is supplied to the pixels 11 of the display panel 10 through the third switch SW3. Thus, when the low power mode is changed into the normal mode, the high potential power voltage VDDEL supplied to the pixels 11 of the display panel 10 and a current IPNL flowing in the display panel 10 increase as shown in FIGS. 7 and 10.

The anode electrode of the diode 101 is connected to the first switch SW1. The cathode electrode of the diode 101 is connected to the first resistor R1 of the feedback voltage divider circuit of the power generator 50, the high voltage power supply terminal VDDEL of the display panel 10, and the capacitor C. It is preferable, but not required, that the diode 101 is a Schottky diode that may operate at high speed.

Figure 7:
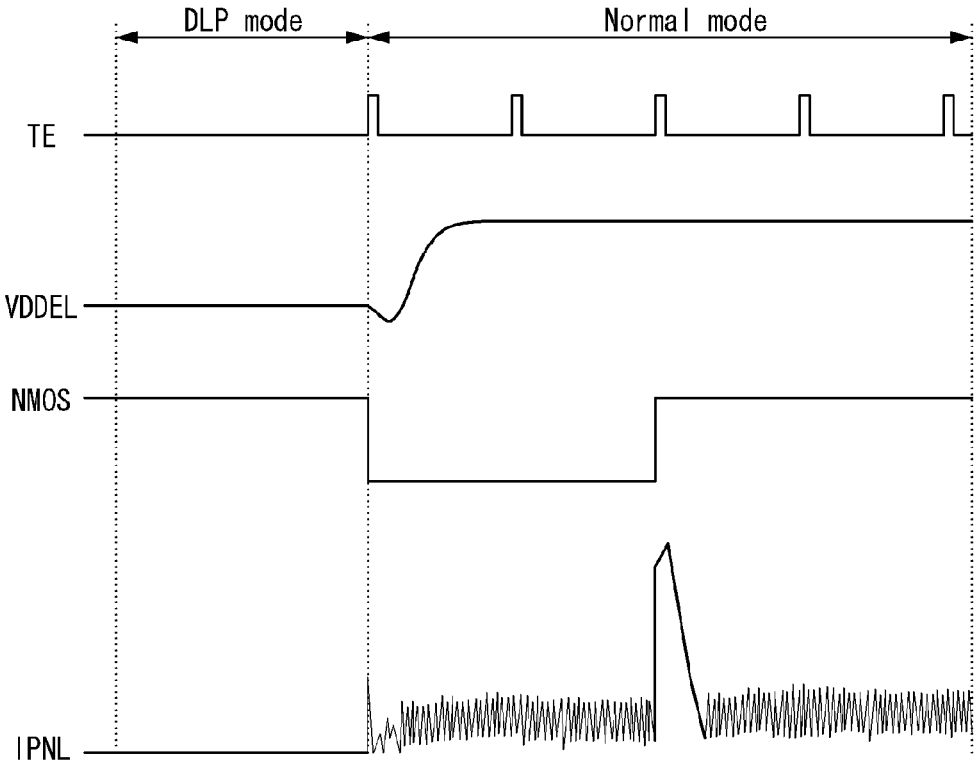
FIG. 7 illustrates an experimental result indicating a temporary, rapid increase in the current of a display panel when the operation mode of the display panel is changed from a low power mode to a normal mode.

As shown in FIG. 7, when the low power mode is changed into the normal mode, the high potential power voltage VDDEL increases. Further, when the sixth switch TFT M6 is turned on, the current IPNL of the display panel 10 rapidly increases and the luminance of the pixels 11 rapidly increases. As a result, when the low power mode is changed into the normal mode, the screen luminance of the display panel 10 temporarily and rapidly increases. In FIG. 7, 'NMOS' signal is the output voltage of the first low power mode control terminal GPIO1 shown in FIG. 6, i.e., the gate control signal voltage of the sixth switch TFT M6.

Figure 8:
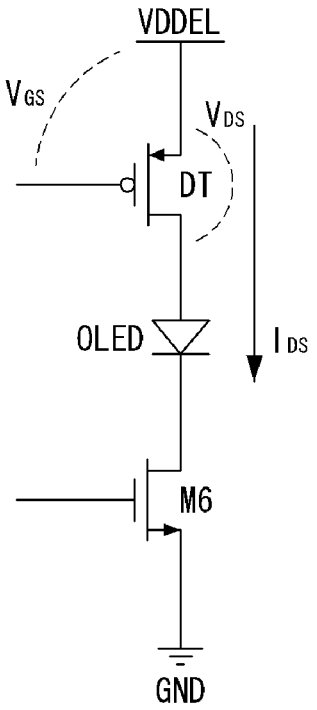
FIGS. 8 and 9 illustrate the voltage-current characteristics of a driving thin film transistor (TFT)
Figure 9:
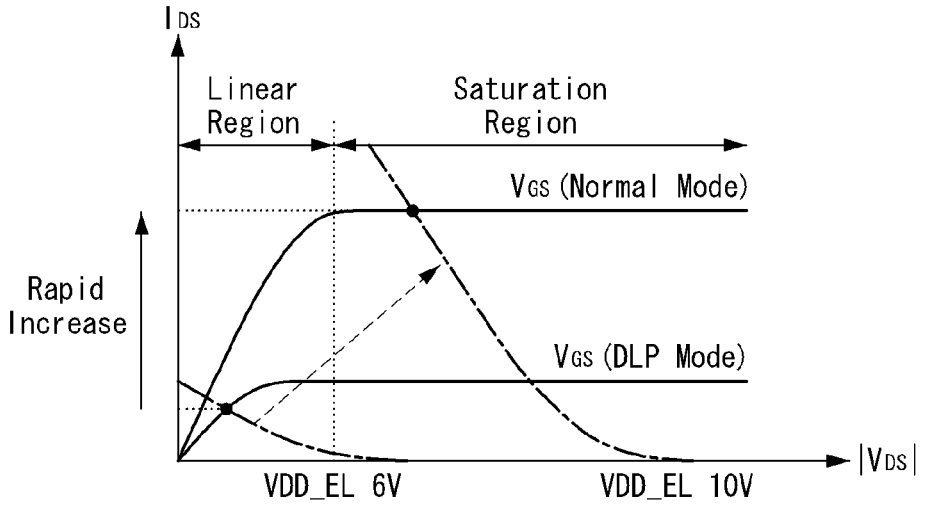

When the high potential power voltage VDDEL increases as shown in FIG. 7, the driving TFT DT operates in a linear region, in which a drain-to-source current $I_{DS}$ quickly increases as much as a change of a gate-to-source voltage $V_{GS}$ as shown in FIGS. 8 and 9. Afterwards, when the high potential power voltage VDDEL is uniformly maintained, the driving TFT DT operates in a saturation region. The drain-to-source current $I_{DS}$ of the driving TFT DT in the saturation region increases as much as the gate-to-source voltage $V_{GS}$ increasing due to the high potential power voltage VDDEL of the normal mode and then is held at a predetermined level. Thus, when the driving TFT DT operates in the linear region, charges are quickly accumulated on the anode electrode of the OLED and the OLED emits light by the leakage current of the OLED. As a result, when the low power mode (or a DLP mode) is changed into the normal mode, a user may feel a screen flicker because the luminance of the pixels 11 temporarily and rapidly increases. In FIG. 9, the dotted line crossing a gate-to-source voltage ($V_{GS}$) curve of the driving TFT DT is a current curve of the OLEDs of the pixels 11.

When the low power mode is changed into the normal mode, the main reason generating the rapid change in the luminance of the pixels 11 is that the high potential power voltage VDDEL increases. The gate-to-source voltage $V_{GS}$ of the driving TFT DT changes as much as a changed amount of the high potential power voltage VDDEL, and a change amount of the luminance of the pixels 11 increases as the gate-to-source voltage $V_{GS}$ of the driving TFT DT increases. The change of the high potential power voltage VDDEL of the pixel 11 may be compensated during one horizontal period (i.e., the times t1 to t3 of FIG. 3), in which the scan pulse SCAN is generated. However, when the high potential power voltage VDDEL changes during a remaining frame period, the luminance of the pixels changes.

The OLED display according to the embodiment herein applies at least one of the following methods (1) to (5), so as to prevent the user from perceiving the rapid change in the luminance of the display panel 10 when the low power mode is changed into the normal mode.

Figure 13:
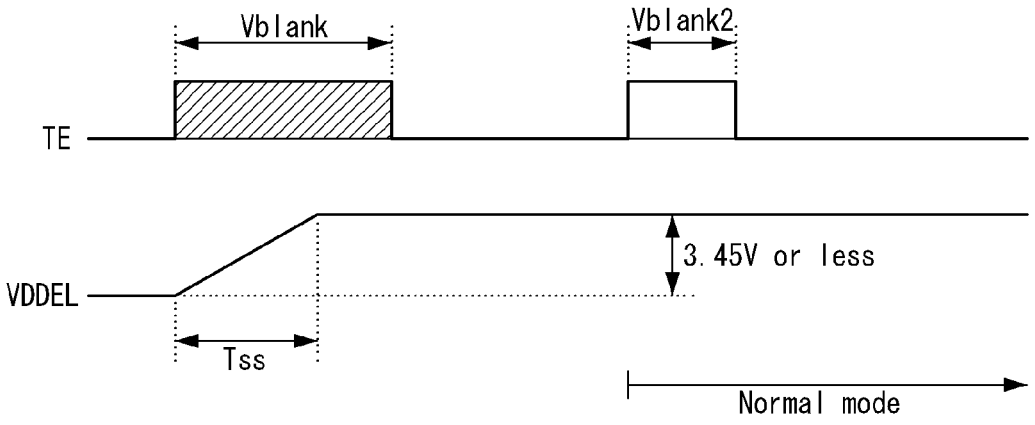
FIG. 13 illustrates that a vertical blank period widens for a predetermined period of time immediately after the operation mode of the OLED display is changed from a low power mode to a normal mode, and a soft start time of a power generator is controlled within the widening vertical blank period.

Method (1): Immediately after the operation mode of the OLED display exits from the low power mode and is changed into the normal mode, the OLED display synchronizes an enable time of the power generator 50 with a vertical blank period Vblank. The enable time of the power generator 50 may be controlled by a timing of the enable signal output through the second low power mode control terminal GPIO2. That is, the disable signal is generated at a logic high level to allow power generator 50 *o* operate in normal mode at a timing synchronized with the vertical blank period Vblank. During the vertical blank period Vblank, there is no input mage, and data is not written to the pixels 11 of the display panel 10. In FIGS. 10, 12, and 13, the vertical blank period Vblank corresponds to a high logic level period of a frame period division signal, i.e., a tearing effect (TE) signal.

In FIG. 12, '13*h*' is a normal mode-on command code transferred to the panel driving circuit chip 100 from the host system 60. '38*h*' is a low power mode-off (PIM/DLP/Idle mode off) command code transferred to the panel driving circuit chip 100 from the host system 60. An operation mode of the panel driving circuit chip 100 is changed from the low power mode into the normal mode in response to the command codes 13*h* and 38*h*.

Method (2): Immediately after the operation mode of the OLED display exits from the low power mode and is changed into the normal mode, the vertical blank period Vblank widens for a predetermined period of time as shown in FIG. 13, and the output (i.e., the high potential power voltage VDDEL) of the power generator 50 increases to a target potential of the normal mode during the widening vertical blank period Vblank. In the normal mode after the predetermined period of time passed immediately after the low power mode is changed into the normal mode, a width of the vertical blank period Vblank may be reduced to a vertical blank period Vblank2 as shown in FIG. 13. Further, in the low power mode, the width of the vertical blank period Vblank may be reduced to the vertical blank period Vblank2. In FIG. 13, the width of the vertical blank period Vblank may be set to be about two times a width of the vertical blank period Vblank2. Immediately after the operation mode of the OLED display exits from the low power mode and is changed into the normal mode, a soft start time Tss (refer to FIG. 13) of the power generator 50, in which the output (i.e., the high potential power voltage VDDEL) of the power generator 50 increases, exists within the predetermined period of time. For example, as shown in FIG. 12, the predetermined period of time may be set to two frame periods of the normal mode. Alternatively, the predetermined period of time may be set to one to five frame periods.

Figure 11:
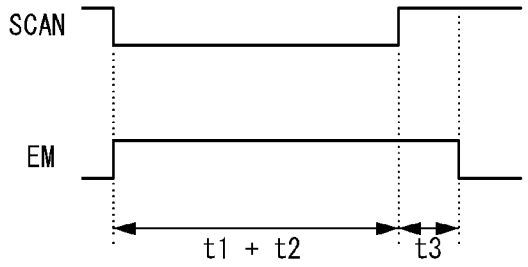
FIG. 11 is a waveform diagram illustrating that the pulse start time of a scan pulse is synchronized with the pulse start time of a light emitting control pulse for a predetermined period of time immediately after the operation mode of the OLED display is changed from a low power mode to a normal mode.

Method (3): During the initial time t1 of FIG. 3, all the switch TFTs of the pixels 11 are turned on, and the abnormally high current flows in the OLED when the high potential power voltage VDDEL rapidly increases. Hence, the luminance of the pixels 11 may rapidly increase. Thus, immediately after the operation mode of the OLED display exits from the low power mode and is changed into the normal mode, the initial time t1, during which the voltages of both the scan pulse SCAN and the light emitting control pulse EM are generated at the low logic level, is omitted for a predetermined period of time. That is, as shown in FIGS. 11 and 12, immediately after the operation mode of the OLED display exits from the low power mode and is changed into the normal mode, the OLED display synchronizes the pulse start time of the scan pulse SCAN with the pulse start time of the light emitting control pulse EM for the predetermined period of time.

As shown in FIG. 3, in the low power mode and the normal mode after the predetermined period of time passed, there is a time difference between the pulse start time of the scan pulse SCAN and the pulse start time of the light emitting control pulse EM. Namely, the pulse start time of the scan pulse SCAN is earlier than the pulse start time of the light emitting control pulse EM. The time difference is set to the initial time t1 of the pixel 11. In the method (3), this separate time difference t1 does not exist, and t1 and t2 are combined such that both the SCAN pulse and the EM pulse start substantially at the same time, as shown in FIG. 11.

Method (4): According to an experimental result, when the low power mode was changed into the normal mode, the observer could not perceive the rapid change of the luminance when a amount of change of the high potential power voltage VDDEL did not exceed about 3.45V as indicated in the following Table 1 and FIG. 13. It is preferable, but not required, that the high potential power voltage VDDEL in the low power mode is less than the high potential power voltage VDDEL in the normal mode by an amount not less than about 2.7V, so as to sufficiently obtain a reduction effect of the power consumption. Thus, in one embodiment a difference between the high potential power voltage VDDEL of the low power mode and the high potential power voltage VDDEL of the normal mode is set to about 2.7V to 3.45V, so as to reduce power consumption in the low power mode and prevent rapid changes in the luminance of the pixels 11 when the low power mode is changed into the normal mode.

When the high potential power voltage VDDEL in the normal mode is less than about 8V, the luminance in the normal mode is not sufficient and the pixels 11 may not normally operate. Thus, in one embodiment the high potential power voltage VDDEL in the normal mode is set to about 8V to 10V, and the difference between the high potential power voltages VDDEL of the low power mode and the normal mode is set to about 2.7V to 3.45V as explained above.

TABLE 1

| VDDEL in low power mode | VDDEL in normal mode | Abnormal change in luminance |
|---|---|---|
| 5.3 V | 10 V | Generated |
| 5.3 V | 9.5 V | Generated |
| 5.3 V | 8.75 V | Not generated |
| 5.3 V | 8.5 V | Not generated |
| 5.3 V | 8 V | Not generated |

Method (5): The rate of increase in the amount of current flowing in the pixels when the low power mode is changed into the normal mode is substantially proportional to the amount of time it takes for the high potential power voltage VDDEL to change. According to an experimental result, when the soft start time Tss (refer to FIG. 13) of the power generator 50 was equal to or less than about 2 ms as indicated in the following Table 2, rapid changes in the luminance of the pixels 11 was prevented. Thus, in one embodiment, the soft start time Tss of the power generator 50 is set to exist within the vertical blank period Vblank and to be greater than zero and equal to or less than about 2 ms.

TABLE 2

| Soft start time Tss | Abnormal change of luminance |
|---|---|
| 500 μs | Not generated |
| 1 ms | Not generated |
| 1.5 ms | Not generated |
| 1.75 ms | Not generated |
| 2 ms | Not generated |
| 2.5 ms | Generated |

As described above, immediately after the operation mode of the OLED display is changed from the low power mode into the normal mode, the OLED display controls the enable time of the power generator within the vertical blank period and controls the soft start time of the power generator within the vertical blank period. As a result, the OLED display according to the embodiments herein may prevent rapid changes in the luminance of the pixels when the low power mode is changed into the normal mode.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting diode (OLED) display comprising:

a display panel including data lines, scan lines intersecting with the data lines, and a plurality of pixels each of which includes an organic light emitting diode and are arranged in a matrix form;

a power generator configured to generate a first voltage as a supply voltage for driving the pixels of the display panel in a first mode of the OLED display and is disabled in a second mode of the OLED display, and further configured to detect a variation of a feedback signal input to a feedback terminal through a feedback voltage divider circuit comprised of first and second resistors and uniformly hold first voltage supplied to the pixels of the display panel even when a load of the display panel changes; and a panel driving circuit configured to drive the data lines and the scan lines of the display panel, the panel driving circuit further configured to disable the power generator in the second mode and provide a second voltage lower than the first voltage as the supply voltage for driving the pixels of the display panel in the second mode, the panel driving circuit comprising:

a charge pump configured to receive a battery voltage from outside and to increase the battery voltage to the second voltage;

a first switch configured to be turned on in response to a mode conversion command received from a host system through a buffer to enter the second mode;

a buffer configured to inverse a low logic level of the mode conversion command in the second mode into a high logic level; and a diode configured to supply the second voltage output from the charge pump to the pixels when the first switch turns on and forms current path between the charge pump and the diode, wherein responsive to change of an operation mode of the OLED display from the second mode to the first mode, the power generator is configured to generate the first voltage for driving the display panel at a time synchronized with a vertical blank period of an image signal to be displayed on the OLED display.

2. The organic light emitting diode display of claim 1, wherein responsive to change of the operation mode of the OLED display from the second mode to the first mode, an enable time and a soft start time of the power generator exist within the vertical blank period.

3. The organic light emitting diode display of claim 1, wherein the first mode is a normal operation mode and the second mode is a low power operation mode of the OLED display.

4. The organic light emitting diode display of claim 1, wherein each of the pixels includes:

a first transistor which forms a current path between the data line and a first node in response to a scan pulse supplied through a first scan line;

a second transistor which is turned off in response to a light emitting control pulse of a supplied through a second scan line, the second transistor when turned on providing a reference voltage to the first node;

a third transistor which forms a current path between a second node and a third node in response to the scan pulse;

a fourth transistor which is turned off in response to the light emitting control pulse, the fourth transistor when turned on forming a current path between the third node and an anode of the organic light emitting diode;

a fifth transistor when turned on supplying the reference voltage to the anode of the organic light emitting diode in response to the scan pulse;

a drive transistor including a gate electrode coupled to the second node, a source electrode coupled to the supply voltage, and a drain electrode coupled to the third node; and a capacitor coupled between the first node and the second node, and wherein the anode of the organic light emitting diode is connected to the fourth transistor and the fifth transistor.

5. The organic light emitting diode display of claim 4, wherein responsive to change of the operation mode of the OLED display from the second mode to the first mode, a pulse start time of the scan pulse is synchronized with a pulse start time of the light emitting control pulse for a predetermined period of time.

6. The organic light emitting diode display of claim 5, wherein after the predetermined period of time passed, the scan pulse and the light emitting control pulse are at different logic levels.

7. The organic light emitting diode display of claim 1, wherein a difference between the first voltage and the second voltage is not more than 3.45V.

8. The organic light emitting diode display of claim 1, wherein a difference between the first voltage and the second voltage is in a range of 2.7 V to 3.45 V.

9. The organic light emitting diode display of claim 1, wherein the first voltage is in a range of 8V to 10V.

10. The organic light emitting diode display of claim 1, wherein a soft start time during which the supply voltage changes from the second voltage to the first voltage responsive to change of the operation mode of the OLED display from the second mode to the first mode is not more than 2 ms.

11. A method of operating an organic light emitting diode (OLED) display including a plurality of pixels each of which includes an organic light emitting diode and are arranged in a matrix form, the method comprising:

responsive to the OLED display being in a first mode, generating a first voltage as a supply voltage for driving the pixels of the OLED display;

responsive to the OLED display being in a second mode, generating a second voltage lower than the first voltage as the supply voltage for driving the pixels of the OLED display, said generating a second voltage lower than the first voltage comprising:

receiving a battery voltage from outside and increasing the battery voltage to the second voltage with a charge pump;

turning on a first switch in response to a mode conversion command received from a host system through a buffer to enter the second mode; and supplying the second voltage output from the charge pump to the pixels when the first switch turns on and forms current path between the charge pump and a diode; and responsive to change of an operation mode of the OLED display from the second mode to the first mode, generate the first voltage for driving the display panel at a time synchronized with a vertical blank period of an image signal to be displayed on the OLED display.

12. The method of claim 11, wherein responsive to change of the operation mode of the OLED display from the second mode to the first mode, an enable time and a soft start time of the power generator exist within the vertical blank period of an image signal to be displayed on the OLED display.

13. The method of claim 11, wherein the first mode is a normal operation mode and the second mode is a low power operation mode of the OLED display.

14. The method of claim 11, wherein a difference between the first voltage and the second voltage is not more than 3.45V.

15. The method of claim 11, wherein a difference between the first voltage and the second voltage is in a range of 2.7 V to 3.45 V.

16. The method of claim 11, wherein the first voltage is in a range of 8V to 10V.

17. The method of claim 11, wherein a soft start time during which the supply voltage changes from the second voltage to the first voltage responsive to change of the operation mode of the OLED display from the second mode to the first mode is not more than 2 ms.

* * * * *